US007189105B2

(12) United States Patent
Takaku et al.

(10) Patent No.: US 7,189,105 B2
(45) Date of Patent: Mar. 13, 2007

(54) CONNECTOR SUITABLE FOR CONNECTION OF A THIN SHEET MEMBER

(75) Inventors: Masaaki Takaku, Saitama (JP); Naoto Imai, Kanagawa (JP); Hideyuki Noguchi, Tokyo (JP); Yoshimasa Kishiku, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/311,113

(22) Filed: Dec. 19, 2005

(65) Prior Publication Data

US 2006/0134969 A1 Jun. 22, 2006

(30) Foreign Application Priority Data

Dec. 20, 2004 (JP) ..... 2004-367494

(51) Int. Cl.
*H01R 12/24* (2006.01)

(52) U.S. Cl. ..... 439/497; 439/98

(58) Field of Classification Search ..... 439/98, 439/697, 610, 492, 497
See application file for complete search history.

(56) References Cited

U.S. PATENT DOCUMENTS 6,924,855 B2 * 8/2005 Chung ..... 349/58
6,979,224 B2 * 12/2005 Boemmel et al. ..... 439/492
7,083,465 B2 * 8/2006 Wu ..... 439/497

FOREIGN PATENT DOCUMENTS

JP 11135203 5/1999
JP 2003243071 8/2003

* cited by examiner

*Primary Examiner*—Khiem Nguyen
(74) *Attorney, Agent, or Firm*—Collard & Roe, P.C.

(57) ABSTRACT

In a connector for connecting a thin sheet member to a mating object, a conductive shell portion collectively covering a base insulator and a cover insulator in a predetermined direction. The base insulator has a through hole penetrating therethrough in the predetermined direction. The cover insulator is cooperated with the base insulator and is for holding the thin sheet member in the predetermined direction. The shell portion has a first spring part to be brought into press contact with the thin sheet member via the through hole and a second spring part for pressing the cover insulator towards the thin sheet member.

13 Claims, 9 Drawing Sheets

CONNECTOR SUITABLE FOR CONNECTION OF A THIN SHEET MEMBER

This application claims priority to prior Japanese patent application JP 2004-367494, the disclosure of which is incorporated herein by reference.

BACKGROUND OF THE INVENTION

This invention relates to a connector for connecting a thin sheet member, such as a flexible flat cable (FFC) or a flexible printed board (FPC), to an electronic apparatus or the like.

A connector of the type is disclosed, for example, in Japanese Unexamined Patent Application Publication (JP-A) No. H11-135203 and comprises an upper-side member and a lower-side member disposed on an upper surface and a lower surface of a FPC, respectively, and coupled to each other. The FPC has a front end face which is exposed without being covered with the upper-side and the lower-side members. Accordingly, when the connector is connected to a mating connector, the mating connector may possibly collide with the front end face of the FPC to separate or peel off the FPC.

Japanese Unexamined Patent Application Publication (JP-A) No. 2003-243071 discloses another connector for connecting a FPC. The connector has a structure covering a front end face of the FPC. With this structure, there is a less risk of separation of the FPC by collision of a mating connector when the connector is connected to the mating connector.

However, the FPC is provided with a through hole for reliably fixing the FPC to the connector. Due to the presence of the through hole, conductor wires of the FPC are partly interrupted. As a result, the number of signal lines is decreased as compared with a FPC having a same width and no through hole.

On the other hand, proposal has been made of a thin sheet member comprising a thin sheet base member having a flat upper surface and a flat lower surface faced to each other, a plurality of conductor wires disposed on the upper surface, and a shield layer disposed on the lower surface. The thin sheet member may be used in a state where the shield layer is electrically connected to at least one of the conductor wires via at least one through hole between the upper and the lower surfaces of the base member. In this state, the conductor wire connected to the shield layer is used as a ground line while the remaining conductor wires are used as signal lines. Therefore, the number of the conductor wires used as the signal lines is reduced.

In any event, it is unfavorable for reduction in size of the connector to form a through hole in a flat member such as a FFC or a FPC and to use a conductor wire as a ground line because the number of signal lines is reduced.

SUMMARY OF THE INVENTION

It is therefore an object of this invention to provide a connector which can be reduced in size and which is capable of easily connecting and reliably fixing a thin sheet member without reducing the number of conductor wires used as signal lines.

It is another object of this invention to provide a connector in which a shield member of a thin sheet member can be used as a ground line without being connected to a conductor wire.

Other objects of the present invention will become clear as the description proceeds.

According to an aspect of the present invention, there is provided a connector for connecting a thin sheet member to a mating object. The connector comprising a base insulator having a through hole penetrating therethrough in a predetermined direction, a cover insulator cooperated with the base insulator for holding the thin sheet member in the predetermined direction, a conductive shell portion collectively covering the base insulator and the cover insulator in the predetermined direction, the shell portion having a first spring part to be brought into press contact with the thin sheet member via the through hole and a second spring part for pressing the cover insulator towards the thin sheet member.

DESCRIPTION OF THE PREFERRED EMBODIMENTS

Figure 1:
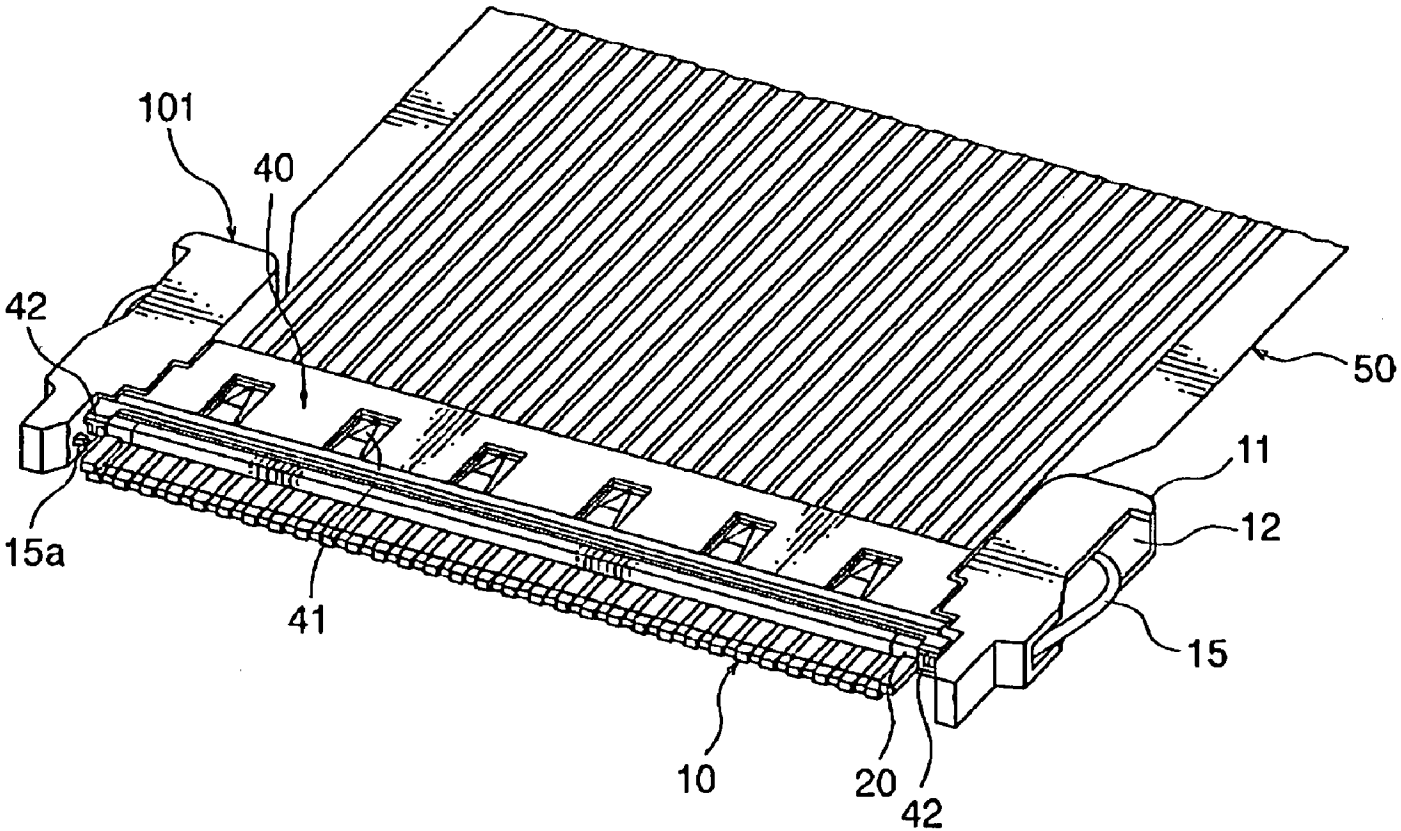
FIG. 1 is a perspective view showing a condition where a flexible flat cable is connected to a connector according to a first embodiment of this invention.

Referring to FIG. 1 to 5, description Will be made of a connector according to a first embodiment of this invention.

In FIGS. 1 to 4, the connector depicted by a reference numeral 101 is for connecting a flexible flat cable (FFC) 50 as a thin sheet member to an electronic apparatus or a circuit board.

Figure 5:
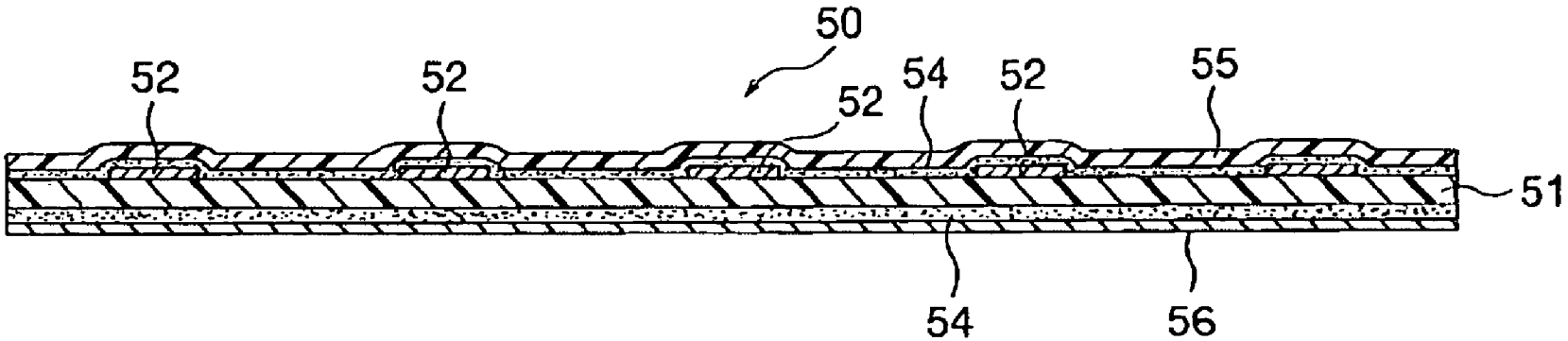
FIG. 5 is an enlarged sectional view taken along a line V—V in FIG. 2A.

As best shown in FIG. 5, the FFC 50 comprises an insulating base member 51 and a number of long and thin conductor wires 52 disposed on an upper surface of the base member 51 in parallel to one another and covered with an insulating sheet 55 via an adhesive layer 54. On the other hand, on a lower surface of the base member 51, a shield layer 56 comprising a conductive film is formed via another adhesive layer which will also be depicted by the same reference numeral 54. The thickness of the base member 51 and the thickness and the width of the conductor wires 52 are selected so as to establish impedance matching.

The connector 101 includes an insulator portion and a shell portion which will be described hereinafter. The insulator portion comprises a base insulator 10 and a cover insulator 20 coupled to the base insulator 10. The shell portion comprises a conductive base shell 30 covering the base insulator 10, and a conductive cover shell 40 covering the cover insulator 20.

In the connector 101, the insulator portion covered with the shell portion clamps and holds one end of the FFC 50 in a predetermined direction. The conductor wires 52 at a front end portion 57 of the FFC 50 are exposed and used as contacting members to be directly connected to mating contacts of a mating connector (see FIG. 6) as a connection object. Thus, the conductor wires 52 at the front end portion 57 of the FFC 50 shown in FIG. 5 are clamped by the base insulator 10 and the cover insulator 20 to be used as the contact members.

Figure 3:
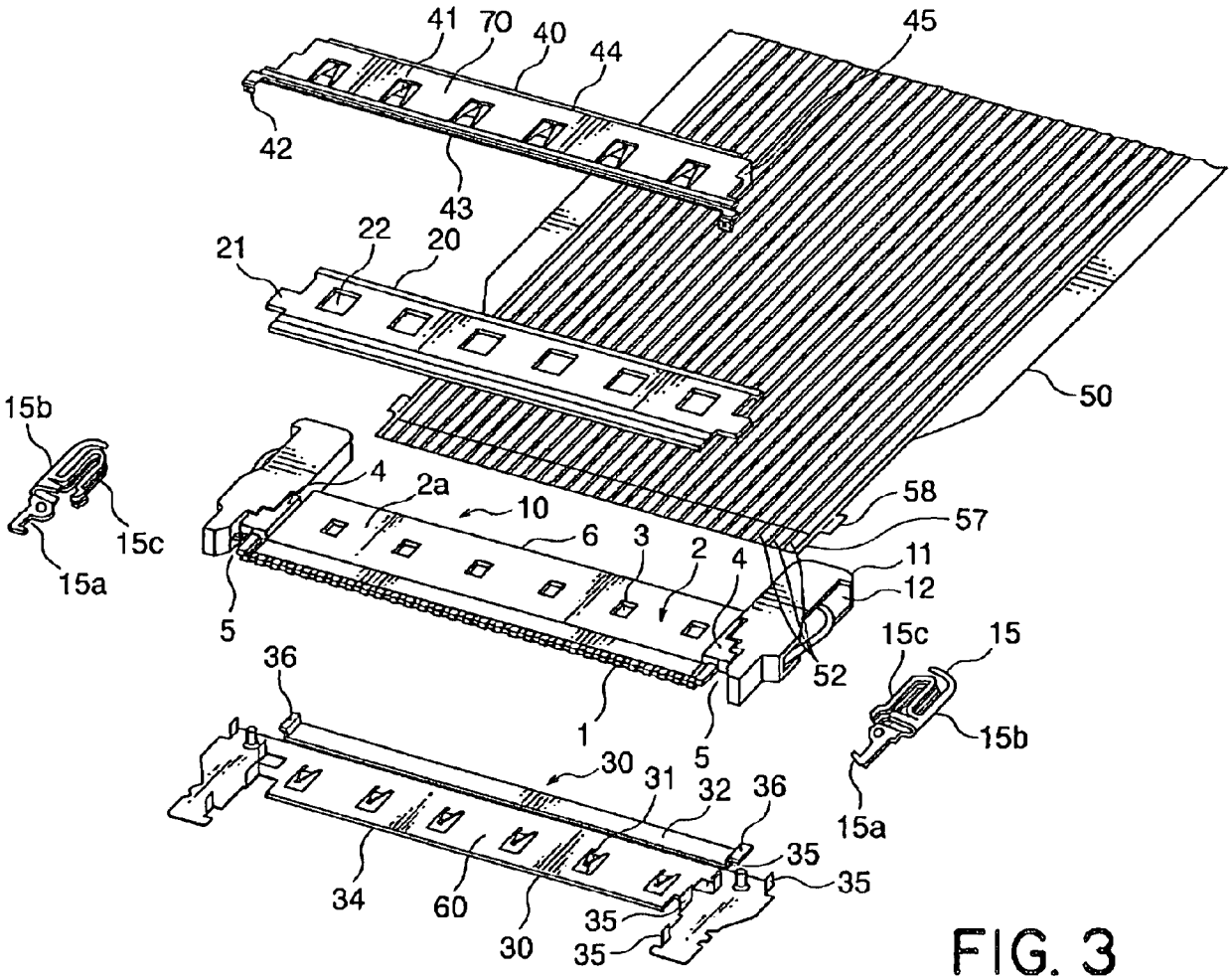
FIG. 3 is an exploded perspective view showing the connector and the flexible cable illustrated in FIG. 1.
Figure 4:
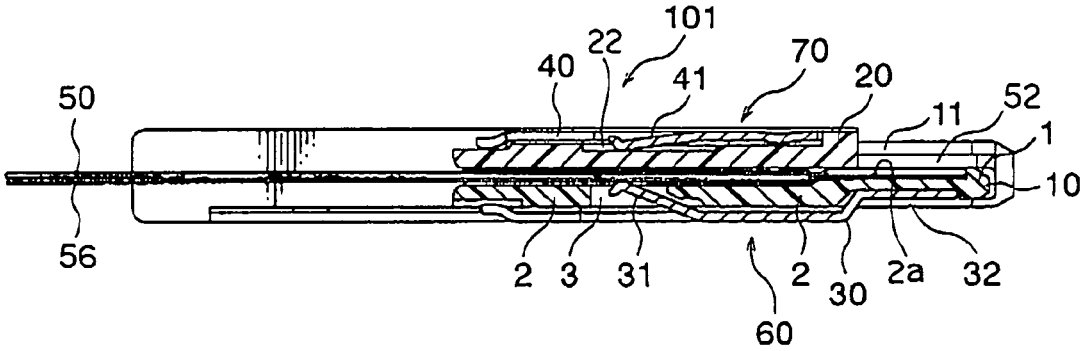
FIG. 4 is a sectional view taken along a line IV—IV in FIG. 2A.
Figure 6:
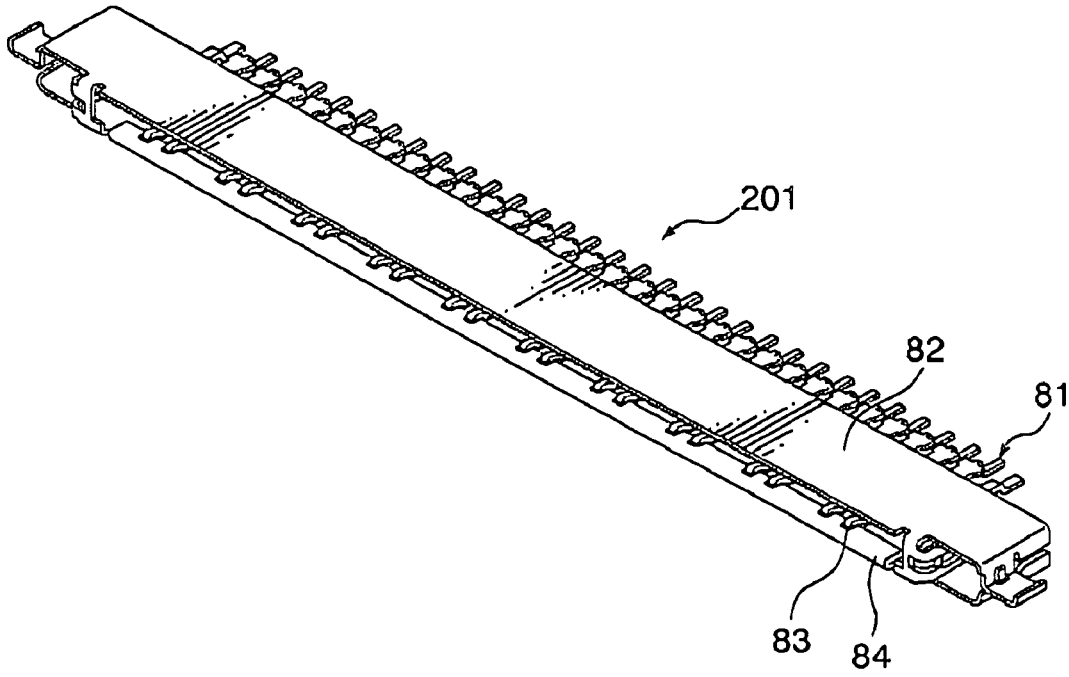
FIG. 6 is a perspective view of a mating connector adapted to be connected to the connector illustrated in FIG. 1.

As best shown in FIG. 3, the base insulator 10 comprises a cable supporting portion 2 of a flat-plate shape and a pair of locking portions 11 formed on opposite sides of the cable supporting portion 2 to lock a connected state between the connector 101 and the mating connector (see FIG. 6). In each of the locking portions 11, a lock lever 15 is received.

The cable supporting portion 2 has an upper surface provided with a depressed portion 2*a* depressed in the predetermined direction to receive the FFC 50. The cable supporting portion 2 has a front end portion (protruding portion) 1 provided with an indented portion and exhibiting a protruding shape as a whole. The front end portion 1 is higher than the upper surface of the cable holding portion 2. Preferably, an indented portion is formed at a rear end portion 6 of the cable supporting portion 2 to clamp the FFC 50.

At the center of the cable supporting portion 2, a plurality of through holes 3 for receiving ends of a plurality of spring parts 31 of the base shell 30 are formed along a widthwise direction of the FFC 50 at intervals corresponding to those of the spring parts 31. The cable supporting portion 2 has rectangular recessed portions 4 formed on opposite sides thereof and depressed outward to reach the locking portions 11. The recessed portions 4 receive protrusions 58 formed near a front end portion of the FFC 50 and rectangular protrusions 21 on opposite sides of the cover insulator 20. On a front side of the cable supporting portion 2, locking grooves 5 are formed on the opposite sides between the cable supporting portion 2 and the locking portions 11. The locking grooves 5 receive locking parts 42 formed on opposite sides of the cover shell 40 so as to fix the cover shell 40.

The cover insulator 20 comprises an insulating flat plate of a long rectangular shape. The cover insulator 20 has an upper surface provided with rectangular recessed portions 22 for receiving spring parts 41 of the cover shell 20.

In FIG. 3, the base shell 30 is shown in a reversed position. The base shell 30 has a contacting portion 32 to be contacted with a shield portion of the mating connector and a first main body 60 integral with the contacting portion 32 and faced to the base insulator 10. The contacting portion 32 has a pair of protrusions 36 having an L shaped section and formed on opposite sides thereof to position the FFC 50. Preferably, a rear end of the main body 60 is provided with an indented portion.

The base shell 30 has a pair of protrusions 35 formed on opposite sides thereof and matched in shape with an outer contour of the locking portions 11. The main body 60 of the base shell 30 is provided with the spring parts 31 formed by cutting.

The cover shell 40 has a front end portion 43 and a second main body 70 integral with the front end portion 43 and faced to the cover insulator 20. The front end portion 43 preferably has an indented edge. Preferably, an edge 44 of the main body 70 is provided with an indented portion.

Further, the cover shell 40 has locking parts 42 formed on opposite sides thereof adjacent to the front end portion 43 and protruding frontward and then bent downward to be fitted to the base insulator 10, and protrusions 45 formed on its rear side.

The second main body 70 is provided with the spring parts 41 formed by cutting and equally spaced in a widthwise direction. The spring parts 41 press recessed portions 22 of the cover insulator 20 to provide a press contact force when the FFC 50 is clamped by the cover insulator 20 and the base insulator 10.

As illustrated in FIG. 3, the conductor wires 52 are exposed at the front end portion 57 of the FFC 50. The protrusions 58 are formed by cutting on opposite sides of the FFC 50 to be adjacent to the front end portion 47 in a longitudinal direction. The protrusions 58 are received in the recessed portions 4 of the base insulator 10 and pressed by the protrusions 21 on the opposite sides of the cover insulator 20 to be fixed. Instead of the FFC 50, a flexible printed circuit board (FPC) may be similarly used as far as the structure is similar.

Next, description will be made of assembling of the above-mentioned connector 101.

Figure 2A:
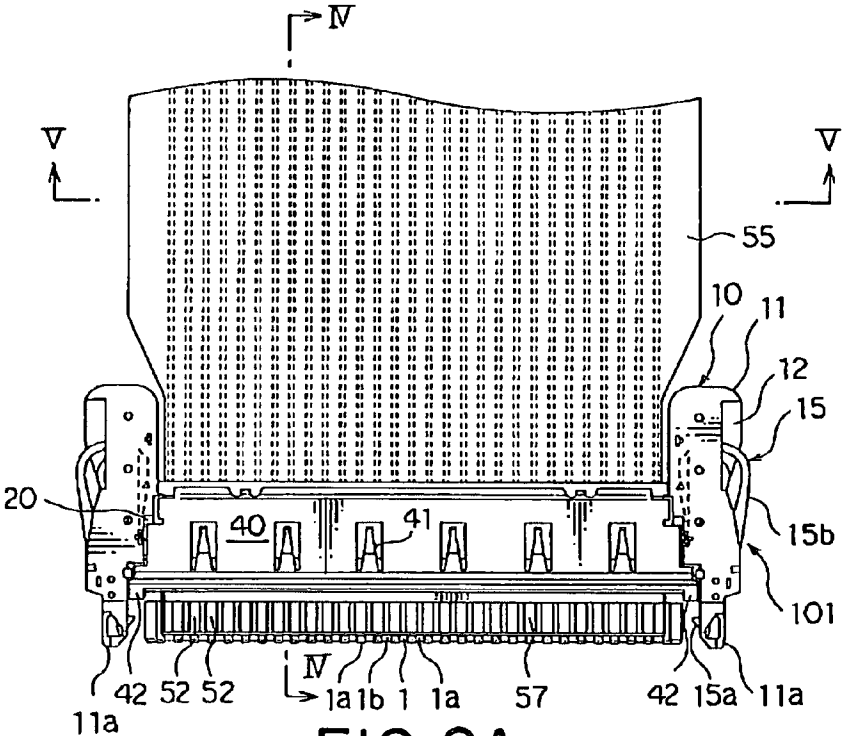
FIG. 2A is a plan view showing the condition of FIG. 1.
Figure 2B:
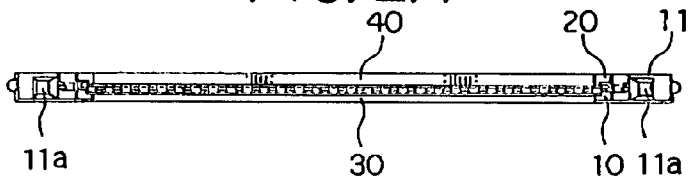
FIG. 2B is a front view showing the condition of FIG. 1.
Figure 2C:
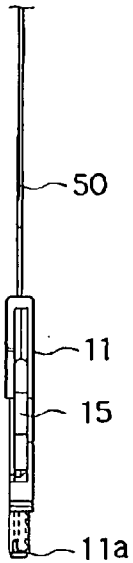
FIG. 2C is a side view showing the condition of FIG. 1.

The protrusions 58 of the FFC 50 are inserted into the recessed portions 4 of the base insulator 10. Thereafter, the protrusions 21 of the cover insulator 20 are inserted into the recessed portions 4 so that the protrusions 58 are clamped by the base insulator 10 and the protrusions 21. Further, the base shell 30 is attached to the base insulator 10. The protrusions 42 of the cover shell 40 are fitted to the locking grooves 5 of the base insulator 10. Thus, the cover insulator 20, the base shell 30, and the cover shell 40 are coupled and fixed to the base insulator 10. As a result, the connector 101 illustrated in FIGS. 1 and 2 is completed.

The connector 101 thus obtained has a structure such that the FFC 50 having the shield layer 56 comprising the conductive film is clamped by the base insulator 10 and the cover insulator 20 and further clamped by the cover shell 20 and the base shell 30. Herein, the spring parts 31 of the base shell 30 are contacted with the shield layer 56 of the FFC 50 so that the base shell 30 is electrically connected to the shield layer 56.

Referring to FIG. 6, the mating connector will be described.

In FIG. 6, the mating connector depicted by a reference numeral 201 comprises a number of conductive contacts 81 and a conductive shield portion 82 surrounding the contacts 81 via an insulator (not shown). To the conductive shield portion 82, a metal member 84 having spring parts 83 is coupled. When the mating connector 201 is mounted to a circuit board (not shown), the metal member 84 is electrically connected to a ground circuit of the circuit board and the contacts 81 are electrically connected to an electric circuit of the circuit board.

Figure 7:
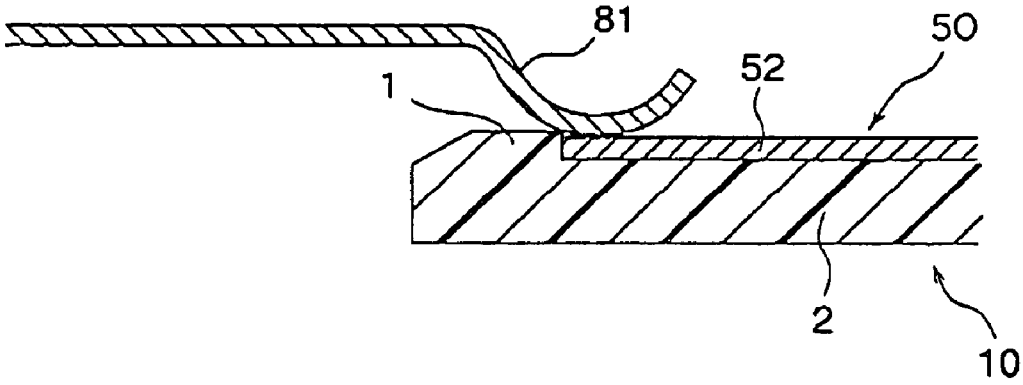
FIG. 7 is a sectional view for describing a connecting operation of connecting the connector in FIG. 1 and the mating connector in FIG. 6.

When the connector 101 illustrated in FIG. 1 is fitted to the mating connector 201, the contacts 81 are brought into contact with the conductor wires 52, respectively, so that a number of signal lines are formed. As illustrated in FIG. 7, the front end portion 1 of the base insulator 10 is higher than the FFC 50. Therefore, the conductor wires 52 are prevented from being peeled off by the contacts 81.

On the other hand, the spring parts 83 are brought into press contact with the contacting portion 32 of the base shell 30. As a consequence, the shield layer 56 of the FFC 50 is electrically connected to the metal member 84 through the base shell 30 and the spring parts 83. Thus, a ground line is formed. Impedance matching is established and noise is blocked.

Figure 8:
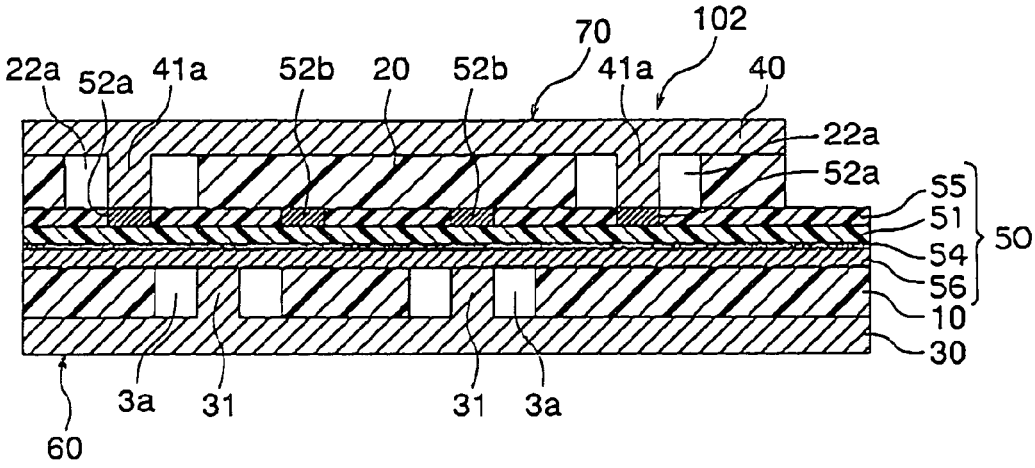
FIG. 8 is a sectional view for describing a connecting operation of a connector according to a second embodiment of this invention.

Referring to FIG. 8, description will be made of a connector according to a second embodiment of this invention. Similar parts are designated by like reference numerals and description thereof will be omitted.

In the connector depicted by a reference numeral 102 in FIG. 8, the cover insulator 20 is provided with a plurality of through holes 22*a* corresponding to some conductorwires 52*a*. The remaining conductor wires 52*b* are covered with the cover insulator 20. On the other hand, the cover shell 40 has a plurality of additional spring parts 41*a* to be brought into contact with the conductor wires 52*a* via the through holes 22*a*.

By the use of the connector 102, the conductor wires 52*b* are used as signal lines while the conductor wires 52*a* are used as ground lines. Accordingly, delicate protection against EMI (electromagnetic interference) known in the art is achieved and the degree of freedom in design is increased in case where the connector 102 is mounted.

Figure 9:
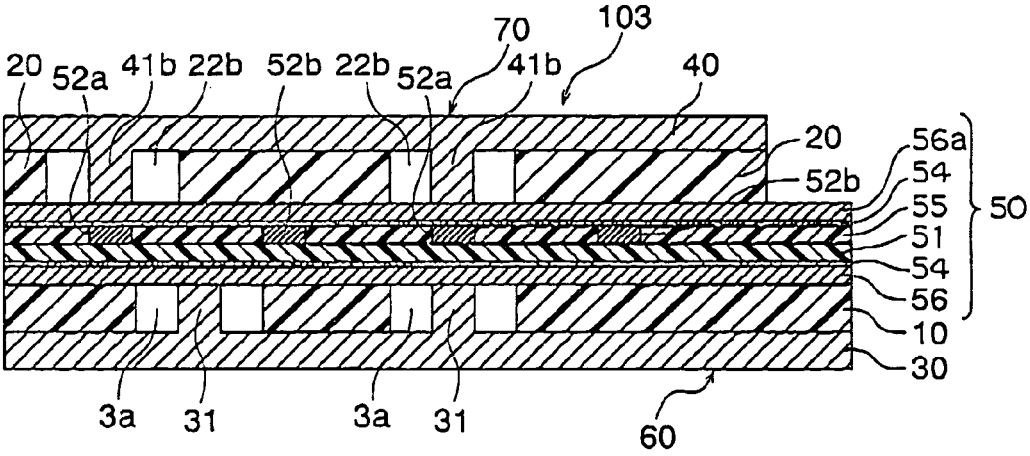
FIG. 9 is a sectional view for describing a connecting operation of a connector according to a third embodiment of this invention.

Referring to FIG. 9, description will be made of a connector according to a third embodiment of this invention. Similar parts are designated by like reference numerals and description thereof will be omitted.

In FIG. 9, the FFC 50 has an additional conductive shield layer 56*a* formed on the insulating sheet 55, in addition to the shield layer 56. The cover insulator 20 of the connector depicted by a reference numeral 103 is provided with a plurality of through holes 22*b*. On the other hand, the cover shell 40 has a plurality of additional spring parts 41*b* to be brought into contact with the additional shield layer 56*a* via the through holes 22*b*.

By the use of the connector 103, the additional shield layer 56*a* is used as a ground line, in addition to the shield layer 56. Accordingly, strong protection is achieved against noise transmission and reception.

Figure 10:
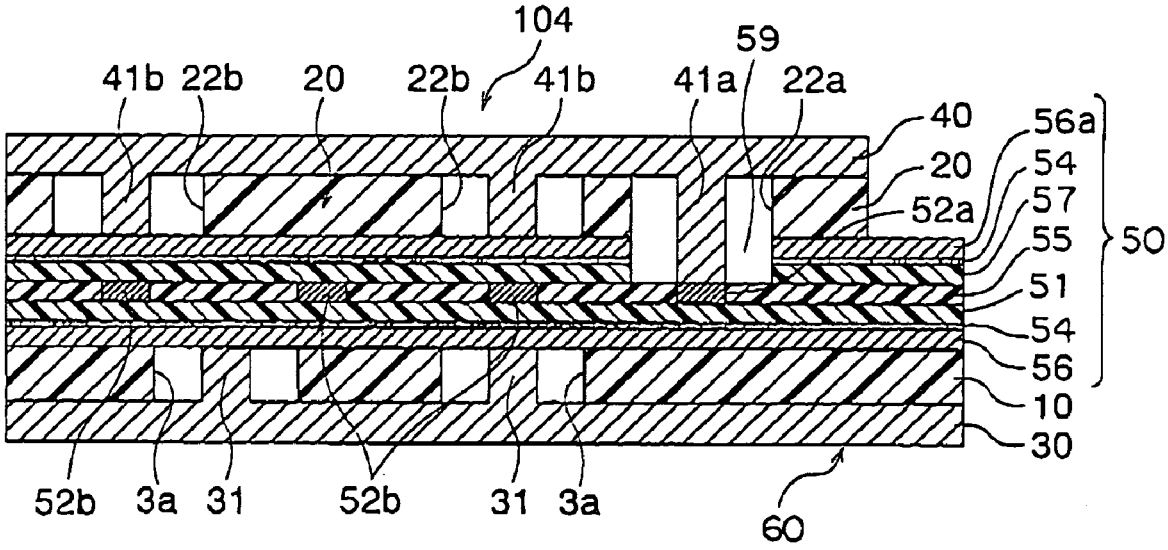
FIG. 10 is a sectional view for describing a connecting operation of a connector according to a fourth embodiment of this invention.

Referring to FIG. 10, description will be made of a connector according to a fourth embodiment of this invention. Similar parts are designated by like reference numerals and description thereof will be omitted.

In FIG. 10, the FFC 50 has an additional insulating sheet 57 between the insulating sheet 55 and the additional shield layer 56*a*, in addition to the structure illustrated in FIG. 9. The FFC 50 is provided with hole portions 59 penetrating the additional shield layer 56*a* and the additional insulating sheet 57 so as to expose some conductor wires 52*a*. The remaining conductor wires 52*b* are covered with the additional insulating sheet 57 and the additional shield layer 56*a*. On the other hand, the cover shell 40 of the connector depicted by a reference numeral 104 has additional spring parts 41*a* to be brought into contact with the conductor wires 52*a* through the through holes 22*a* and additional spring parts 41*b* to be brought into contact with the additional shield layer 56*a* through the through holes 22*b*.

By the use of the connector 104, the conductor wires 52*b* are used as signal lines and the conductor wires 52*a* are used as ground lines. Accordingly, protection against delicate EMI is achieved and the degree of freedom in design is increased in case where the connector 104 is mounted. Further, the additional shield layer 56*a* can be used as the ground line, in addition to the shield layer 56. Accordingly, strong protection is achieved against noise transmission and reception.

Although this invention has been described in conjunction with a few preferred embodiments thereof, this invention may be modified in various other manners. For example, the thin sheet member is not restricted to the FFC but may be a FPC. Further, various types of flexible film-like cables may be used as the thin sheet member.

What is claimed is:

1. A connector for connecting a thin sheet member to a mating object, comprising:

a base insulator having a through hole penetrating therethrough in a predetermined direction;

a cover insulator cooperated with the base insulator for holding the thin sheet member in the predetermined direction;

a conductive shell portion collectively covering the base insulator and the cover insulator in the predetermined direction;

the shell portion having:

a first spring part to be brought into press contact with the thin sheet member via the through hole; and a second spring part for pressing the cover insulator towards the thin sheet member.

2. The connector according to claim 1, wherein the shell portion further has:

a first main body faced to the base insulator in the predetermined direction; and a second main body faced to the cover insulator in the predetermined direction;

the first spring part being coupled to the first main body, the second spring part being coupled to the second main body.

3. The connector according to claim 2, wherein the shell portion further has a connecting portion electrically connecting the first and the second main bodies to each other.

4. The connector according to claim 2, wherein the first main body has a contacting portion to be connected to the mating object.

5. The connector according to claim 2, wherein the cover insulator, the first main body, and the second main body are engaged with the base insulator in the predetermined direction.

6. The connector according to claim 1, wherein the base insulator has a depressed portion for receiving the thin sheet member.

7. The connector according to claim 1, wherein the base insulator further has a pair of locking portions formed at opposite ends of the depressed portion in a direction perpendicular to the predetermined direction, the locking portions being for locking a connected state between the connector and the mating object.

8. The connector according to claim 1, wherein the cover insulator has a recessed portion receiving the second spring part.

9. The connector according to claim 1, wherein the base insulator has a protruding portion faced to an end face of the thin sheet member, the protruding portion having a height greater than a thickness of the thin sheet member.

10. The connector according to claim 1, wherein the cover insulator has a through hole penetrating in the predetermined direction, the shell having an additional spring part to be brought into press contact with the thin sheet member via the through hole of the cover insulator.

11. The connector according to claim 1, wherein the thin sheet member comprises:

a thin sheet base member;

a plurality of conductor wires disposed on one surface of the base member; and a shield layer disposed on the opposite surface of the base member;

the base insulator being faced to the shield layer, the cover insulator being faced to the conductor wires.

12. The connector according to claim 11, wherein the cover insulator has a through hole penetrating therethrough in the predetermined direction, the shell portion having at least one additional spring part to be brought into press contact with at least one of the conductor wires via the through hole of the cover insulator.

13. The connector according to claim 11, wherein the thin sheet member further has an additional shield layer covering the conductor wires via an insulator, the cover insulator having a through hole penetrating therethrough in the predetermined direction, the shell portion having at least one additional spring part to be brought into contact with the additional shield layer via the through hole of the cover insulator.

* * * * *